US006062200A

United States Patent [19]

Hofmeister

[11] Patent Number: 6,062,200

[45] Date of Patent: May 16, 2000

[54] MOTOR FUEL DISPENSER

[75] Inventor: Werner Hofmeister, Hühlacker, Germany

[73] Assignee: Robert Bosch GmbH, Stuttgart, Germany

[21] Appl. No.: 09/068,287

[22] PCT Filed: Aug. 23, 1997

[86] PCT No.: PCT/DE97/01835

§ 371 Date: May 6, 1998

§ 102(e) Date: May 6, 1998

[87] PCT Pub. No.: WO98/13600

PCT Pub. Date: Apr. 2, 1998

[30] Foreign Application Priority Data

Sep. 26, 1996 [DE] Germany ..... 196 39 585

[51] Int. Cl.[7] ..... F02M 37/04

[52] U.S. Cl. ..... 123/470; 123/456

[58] Field of Search ..... 123/470, 469, 123/456, 468, 472

[56] References Cited

U.S. PATENT DOCUMENTS

| | | | |
|---|---|---|---|
| 4,950,171 | 8/1990 | Muszlay | 123/470 |
| 5,209,204 | 5/1993 | Bodenhausen | 123/470 |
| 5,471,961 | 12/1995 | McArthur | 123/470 |
| 5,577,480 | 11/1996 | Gmelin | 123/470 |
| 5,598,824 | 2/1997 | Treusch | 123/470 |
| 5,616,037 | 4/1997 | Lorraine | 123/456 |
| 5,718,206 | 2/1998 | Sawada | 123/470 |
| 5,735,247 | 4/1998 | Tsuzuki | 123/456 |

FOREIGN PATENT DOCUMENTS

| | | |
|---|---|---|
| 0 374 422 | 6/1990 | European Pat. Off. . |
| 0 530 337 | 3/1993 | European Pat. Off. . |
| 30 10 613 | 10/1981 | Germany . |
| 43 25 842 | 2/1995 | Germany . |

*Primary Examiner*—Carl S. Miller
*Attorney, Agent, or Firm*—Kenyon & Kenyon

[57] ABSTRACT

A known fuel distributor for fuel injection systems of internal combustion engines for supplying fuel to at least two fuel injection valves comprises a fuel supply channel and a number of valve receptacles corresponding to the number of fuel injection valves. The valve receptacles each have a valve receptacle opening which communicates directly with the fuel supply channel and into which the connecting segments of the fuel injection valves can be inserted.

With the novel fuel distributor, electric conductors for electric connection to the fuel injection valves which are integrated directly into and/or onto the fuel distributor and lead up to the valve receptacle openings. Contact springs are arranged in each valve receptacle opening so that, after insertion of the connecting segment of one of the fuel injection valves the said contact springs establish contact with contact faces, provided on the connecting segment so they are axially offset relative to one another with respect to the longitudinal axis of the fuel injection valve.

15 Claims, 3 Drawing Sheets

1
2
3
4
5
6
7
8
9
10
11
12
13
14
15
16
17
18
X

MOTOR FUEL DISPENSER

FIELD OF THE INVENTION

The present invention relates to a fuel distributor.

BACKGROUND INFORMATION

European Patent Application No. 0 374 422 describes a fuel distributor having a plurality of connectors into which the fuel injection valves of an internal combustion engine can be inserted, to be in turn supplied with fuel from a fuel distributor. The fuel distributor is made of plastic and has an almost circular, closed fuel channel. The connectors communicate with the fuel channel through an opening in the fuel channel. The fuel distributor, which is mostly rigid, engages in attachment clamps that are provided on the fuel injection valves and permit an axial mounting of the fuel injection valves. Parallel to the fuel channel runs a guide channel which is integrated into the fuel distributor and accommodates a plurality of electric conductors. For electric contacting of the fuel injection valves, a plug connector element provided on the electric conductors engages in a connector provided in the injection valves. The guide channel is provided with a holding receptacle to encompass a mounting section of a connecting part which is attached to the fuel injection valve and on which the connector is provided. This design is complicated and expensive because the connector must be mounted separately on an additional connecting part positioned externally. Furthermore, an additional closing plate which can be rotated using a complicated hinge must be mounted on the guide channel between the individual fuel injection valves.

In addition, German Patent Application no. 30 10 613 describes a fuel injection system for internal combustion engines, including a plurality of electromagnetically operated fuel injection valves and a rigid fuel line, with the fuel line having valve receptacles into which the fuel injection valves can be sealingly inserted. The fuel line is formed by a fuel distributor line with a fuel return line above it. The individual fuel injection valves are each contacted by means of an electric plug connector, thus necessitating additional contacting lines or connector elements and gaskets. Furthermore, it is possible to provide an electric plug on the fuel line in the area of each valve receptacle by means of which the electric connection with the electric plug connector of the fuel injection valve can be established at the same time when the fuel injection valve is inserted into the valve receptacle. This design is also complicated and expensive because a plurality of specially designed plug parts must project out of the fuel line in the direction of the plug connectors.

Another fuel distributor is described in European Patent Application no. This fuel distributor includes a fuel supply channel and valve receptacles which are connected to the fuel supply channel and into which the fuel injection valves can be sealingly inserted. Electric contacting is accomplished by means of plug connector elements which can be snapped onto the side of the housing of the fuel injection valves and are connected by contact lines to electric connecting cables running parallel to the fuel supply channel. The electric connecting cables are arranged inside a contact strip which can be snapped onto the fuel distributor by a catch connection. This design is also relatively complicated and expensive because the contact strip must be manufactured separately from the fuel distributor, and the electric connecting cables must be inserted into the contact strip in an additional manufacturing step.

All of the conventional designs described above are similar in that in mounting the fuel injection valves on the fuel distributor, another assembly step is necessary to establish electric contact in addition to the insertion of the fuel injection valves into the valve receptacles. This is a disadvantage e.g., in automated mass production in particular.

SUMMARY OF THE INVENTION

The fuel distributor according to the present invention is advantageous in that no additional assembly step is necessary for the electric contacting of the fuel injection valves. Instead, electric contacting is accomplished merely by inserting the fuel injection valves into the fuel distributor. Thus, manufacturing costs can be saved, particularly in automated assembly. Furthermore, the connection according to the present invention between the fuel injection valves and the fuel distributor can be easily undone by pulling the fuel injection valves out of the valve receptacles of the fuel distributor. This makes the fuel injection system more repair-friendly in the event of a failure of one fuel injection valve. Due to the integration of the electric conductors in and/or on the fuel distributor according to the present invention, a space-saving design of the fuel distributor is achieved and the number of individual parts is reduced, so the manufacturing costs are also reduced. It is also advantageous that the electric conductors integrated into the fuel distributor are well protected from negative external influences and damage.

Due to a step-shaped design of the valve receptacle openings as well as of the connecting segments of the fuel injection valves, good insulation is achieved between the individual electric contacts due to the spatial distance between the contact springs arranged in different steps in the valve receptacle openings and also between the contact faces arranged in the different steps of the connecting segments. At the same time, the end face of the connecting segments of the fuel injection valves designed between the steps may define a stop on insertion of the fuel injection valves. Due to the layered coaxial design of the connecting segments with a hollow cylindrical conducting core, an outer conductor layer and an insulation layer arranged between them, this yields an especially compact design. Electric shielding of the internal core is achieved with the complete coaxial sheathing of the outer conductor layer which is connected to circuit ground in particular.

According to a further embodiment, the contact faces may be provided with recesses into which the contact springs are snapped. This yields a simple, detachable locking of the fuel injection valves on the fuel distributor.

The electric conductors can be embedded in the fuel distributor during its manufacture, in particular by injection molding. Preferably one of the electric conductors may form a tubular lining on the inside surface of the wall of the fuel supply channel, thus increasing the stability of the fuel supply channel and also achieving a large electric conduction cross section.

DETAILED DESCRIPTION OF THE DRAWINGS

Figure 1:
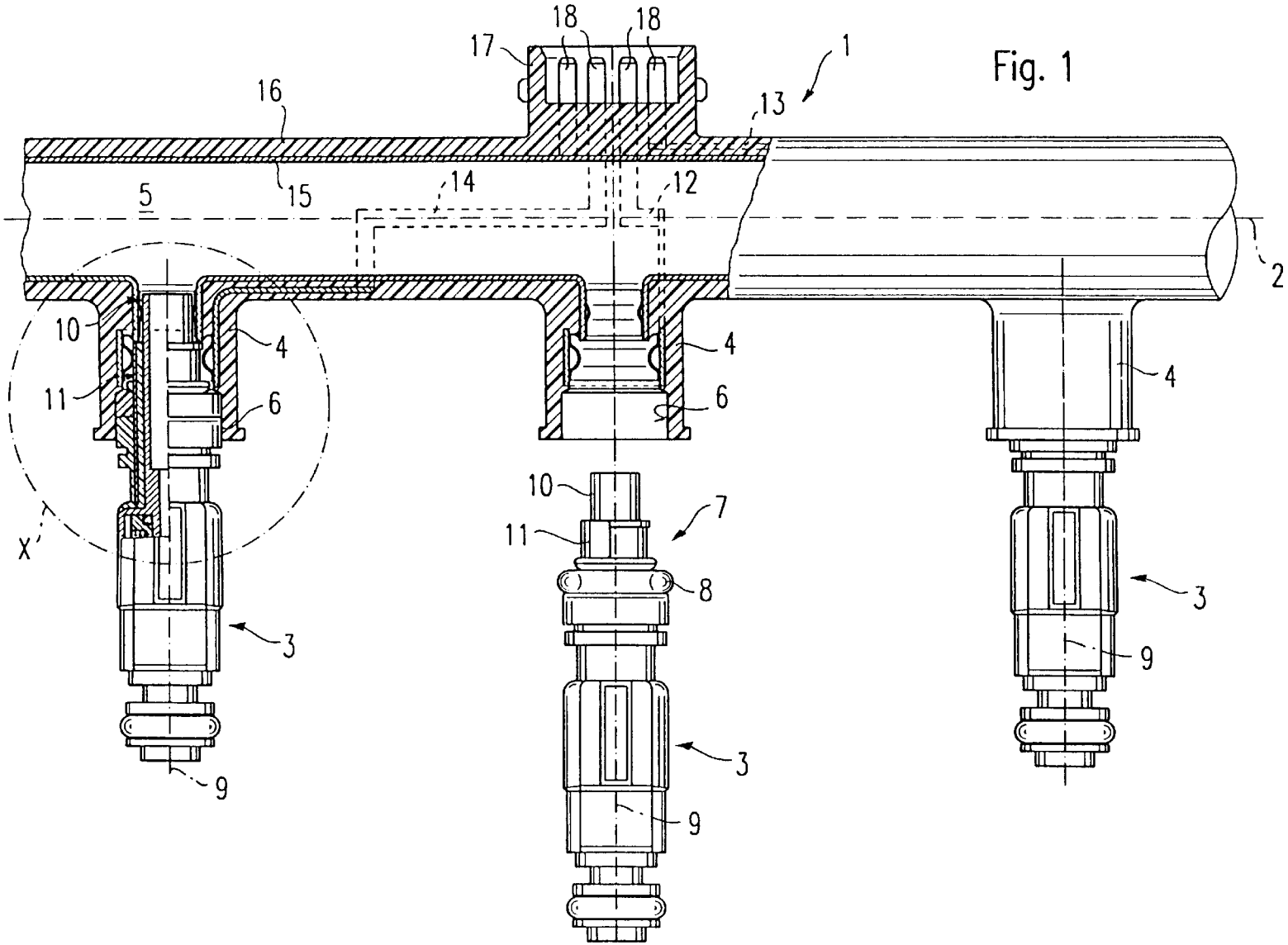
FIG. 1 shows a partial section through a fuel distributor according to the present invention (shown partially in a side view) and fuel injection valves inserted into the fuel distributor.
Figure 2:
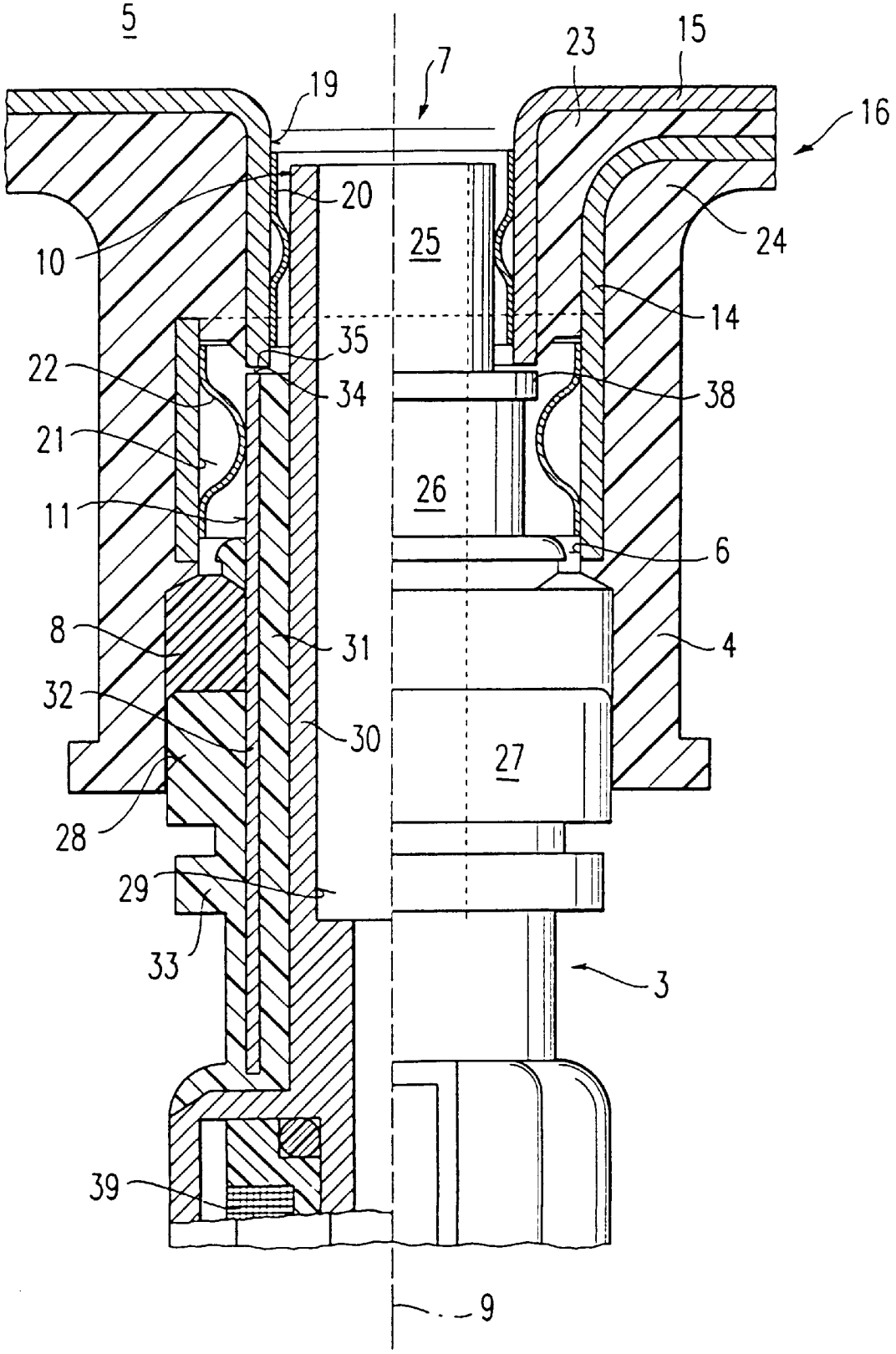
FIG. 2 shows a partial section through the fuel distributor according to the present invention and a fuel injection valve inserted into the fuel distributor in the area of the detail (indicated with an X in FIG. 1).

The fuel distributor shown as an example in FIGS. 1 and 2 for fuel injection systems of internal combustion engines with mixture compression and external ignition is labeled as 1. Fuel distributor 1, which may have an elongated shape, for example, supplying fuel to at least two, e.g., four fuel injection valves 3. To accommodate fuel injection valves 3, fuel distributor 1 has a number of valve receptacles 4 corresponding to the number of fuel injection valves 3 along its longitudinal extent in the direction of its longitudinal axis. In this embodiment, valve receptacles 4 are molded in one piece onto a fuel supply channel 5 extending longitudinally in fuel distributor 1. Fuel distributor 1 is produced preferably by a plastic injection molding process. Valve receptacles 4 extending at a right angle, for example, from the longitudinal extent of fuel supply channel 5 have valve receptacle openings 6 into which connecting segments 7 of fuel injection valves 3 can be inserted. Connecting segments 7 are at least partially surrounded by valve receptacles 4 after being inserted into valve receptacle openings 6 and they are sealed by a gasket 8. To supply fuel to fuel injection valves 3, valve receptacle openings 6 communicate directly with fuel supply channel 5 which runs transversally to valve receptacle openings 6 and has a circular cross section, for example. Valve receptacle openings 6 are thus branch channels of fuel supply channel 5.

Top-feed fuel injection valves, where the fuel is supplied through the end opposite the spray outlet end, are especially suitable as fuel injection valves 3 for use on fuel distributor 1 according to the present invention. Fuel injection valves 3, will not be described in detail because such fuel injection valve 3 is already described in German Patent Application No. 43 25 842. However, other designs of conventional fuel injection valves can also be used on fuel distributor 1 according to the present invention. In contrast with the fuel injection valve described in German Patent Application No. 43 25 842, fuel injection valve 3 which can be inserted into fuel distributor 1 according to the present invention has no plug connector arranged on the side of the housing of fuel injection valve 3. According to the present invention, the plug connector is integrated into connecting segment 7 in the form of contact faces 10, 11 that are offset axially to one another with respect to longitudinal axis 9 of fuel injection valve 3. Therefore, connecting segment 7, which is designed as a hollow body, assumes not only the function of the supplying the fuel but also the function of electric contact for fuel injection valve 3.

Electric conductors 12, 13, 14 and 15 are integrated into or onto fuel distributor 1, which is preferably designed as a molded plastic part. Electric conductors 12, 13 and 14 are designed as ribbon cables in this embodiment and are produced by injection molding together with fuel distributor 1. Electric conductor 15, however, lines the inside surface of wall 16 of fuel supply channel 5 essentially completely in a tubular form. The flexural rigidity of fuel supply channel 5 is increased by tubular line 15 made of metal, and thus the dimensional stability of fuel distributor 1 is improved. Furthermore, the large conduction cross section of tubular line 15 yields an especially low electric conductor resistance. All fuel injection valves 3 can be connected centrally over tubular line 15 to a terminal of a control unit (not shown) that drives serves to fuel injection valves 3, while fuel injection valve 3 can be connected to the circuit ground via electric conductors 12 through 14 over the control unit.

A plug connector 17, which may be molded preferably in one piece on fuel distributor 1, preferably on wall 16 of fuel supply channel 5, extends at a right angle, for example, to longitudinal axis 2 of fuel distributor 1, in particular along an elongated longitudinal axis 9 of a fuel injection valve 3. Terminal pins 18 which are connected to electric conductors 12 through 15 are provided in plug connector 17. Electric conductors 12, 13 and 14, which are designed as ribbon cables are largely sheathed in plastic and therefore protected from external influences. Tubular line 15 may be internally coated with a layer of plastic or enamel (not shown) to insulate tubular line 15 with respect to fuel supply channel 5 and protect it from any harmful effects of the fuel.

FIG. 2, shows an enlarged detail of the area marked as X in FIG. 1, illustrating the connection according to the present invention between the fuel distributor 1 and a connecting segment 7 of a fuel injection valve 3 inserted into a valve receptacle opening 6.

In the embodiment illustrated in FIG. 2, both valve receptacle opening 6 and valve segment 7 of fuel injection valve 3 which can be inserted into valve receptacle opening 6 have a stepped design. A first clamping spring 20 is arranged in a first cylindrical step 19 of valve receptacle opening 6, while a second clamping spring 22 is provided in a second cylindrical step 21 of valve receptacle opening 6. Steps 19 and 21 are arranged axially one after the other and are radially offset. Step 19 is arranged upstream of step 21 and has a smaller inside diameter than step 21. In this embodiment, clamping springs 20 and 22 are designed to encircle at least partially the respective step 19 or 21 of valve receptacle opening 6 and are preferably pressed into the step. The inside wall of steps 19 and 21 is at least partially lined with electric conductors 15 and 14. Electric conductors 15 and 14 are not insulated from the inside of the respective step 19 and 21, so that the respective clamping springs 20 and 22 are electrically connected to the corresponding electric conductors 15 and 14. To achieve an additional locking of clamping springs 20 and 22 and also to improve the electric contact resistance between clamping springs 20 and 22 and the respective electric conductors 15 and 14, each clamping spring 20 and 22 may be additional connected to the respective electric conductors 15 and 14 by soldering or welding.

The annular space occupied by clamping springs 20 and 22 is sealed by gasket 8 described above. This prevents the fuel which is to be supplied to the inlet end of fuel injection valve 3 from valve receptacle opening 6 from escaping at an undesirable location. Electric conductors 14 and 15 are insulated from one another by an insulation layer 23, preferably a plastic layer of fuel distributor 1, which is designed as a plastic molding. Electric conductor 14 is additionally insulated toward the outside by an insulation layer 24, preferably a plastic layer.

Connecting segment 7 of each fuel injection valve 3, which can be inserted into valve receptacle opening 6, also has a stepped design in this embodiment, including steps 25, 26 and 27. While cylindrical step 27 provides axial guidance for connecting segment 7 in a step 28 of valve receptacle opening 6 downstream from steps 19 and 21, cylindrical steps 25 and 26 have on their lateral cylindrical surfaces contact faces 10 and 11 described above, which are contacted by clamping springs 20 and 22, respectively. Cylindrical steps 27, 26 and 25 are designed with tapering diameters from step to step in the direction of the inlet end of connecting segment 7. In a corresponding manner, the diameters of steps 28, 21 and 19 of valve receptacle opening 6 taper in the direction of fuel supply channel 5 opposite the direction of fuel flow. The diameter of step 28 of valve receptacle opening 6 has only a slightly larger diameter than step 27 of connecting segment 7 of fuel injection valve 3 to ensure axial guidance. The difference in diameters of steps 25 and 26 of connecting segment 7 relative to the diameters of steps 19 and 21 of valve receptacle opening 6 and thus the distances between contact face 10 and electric conductor 15 or between contact face 11 and electric conductor 14 are dimensioned so that a reliable electric contact is established between clamping springs 20, 22 and contact faces 10, 11 due to the deformation of contact springs 20 and 22 when valve segment 7 is inserted into valve receptacle opening 6.

Connecting segment 7 is designed as a hollow cylinder and encompasses a central longitudinal opening 29 which opens at the fuel inlet end into valve receptacle opening 6 and fuel supply channel 5 and through which fuel flows toward fuel injection valve 3. Connecting segment 7 is designed in layers in the embodiment shown here and includes a hollow cylindrical core 30 composed of an electrically conducting material, in particular a metal, a first insulation layer 31, made of a plastic material, for example, surrounding the outside of hollow cylindrical core 30, and a conduction layer 32 which is made of a conductive material, in particular a metal, enclosing the first insulation layer 31. An end segment of hollow cylindrical core 30 in the area of contact face 10 is not covered by the first insulation layer 31, so that hollow cylindrical core 20 can be contacted by contact spring 20 in this area. Furthermore, the first insulation layer 31 with a ring section 38 having a larger diameter seals conduction layer 32 on its inlet end to prevent a connection and thus a short-circuit between electric conductor 15 and conduction layer 32.

Outside of contact face 11, conduction layer 32 may be surrounded on the outside by a second insulation layer 33 which also assumes the function of axial guidance of connecting segment 7 in conjunction with step 28 of valve receptacle opening 6 in the area of step 27 of connecting segment 7 in this embodiment. Insulation layer 33 may also be the outer plastic sheathing of fuel injection valve 3. If the external conduction layer 32 surrounds the internal, electrically conducting hollow cylindrical core 30 and is connected to the circuit ground, this has the advantage of electrically shielding the internal hollow cylindrical core 30 from external parasitic voltages.

When inserting connecting segment 7 into valve receptacle opening 6, inlet end face 34 of step 26 strikes against stop face 35 on the edge of step 19. The stepped design of connecting segment 7 and valve receptacle opening 6 therefore has the additional advantage that the end position of connecting segment 7 of fuel injection valve 3 which can be inserted into valve receptacle opening 6 is defined unambiguously.

Contact faces 10, 11 are connected to the ends of a winding of a magnet coil 39, which is shown only schematically. Contact face 11 may be designed as a sleeve or in the form of partial sleeves or one or more strips that do not form a complete circle.

Figure 3:
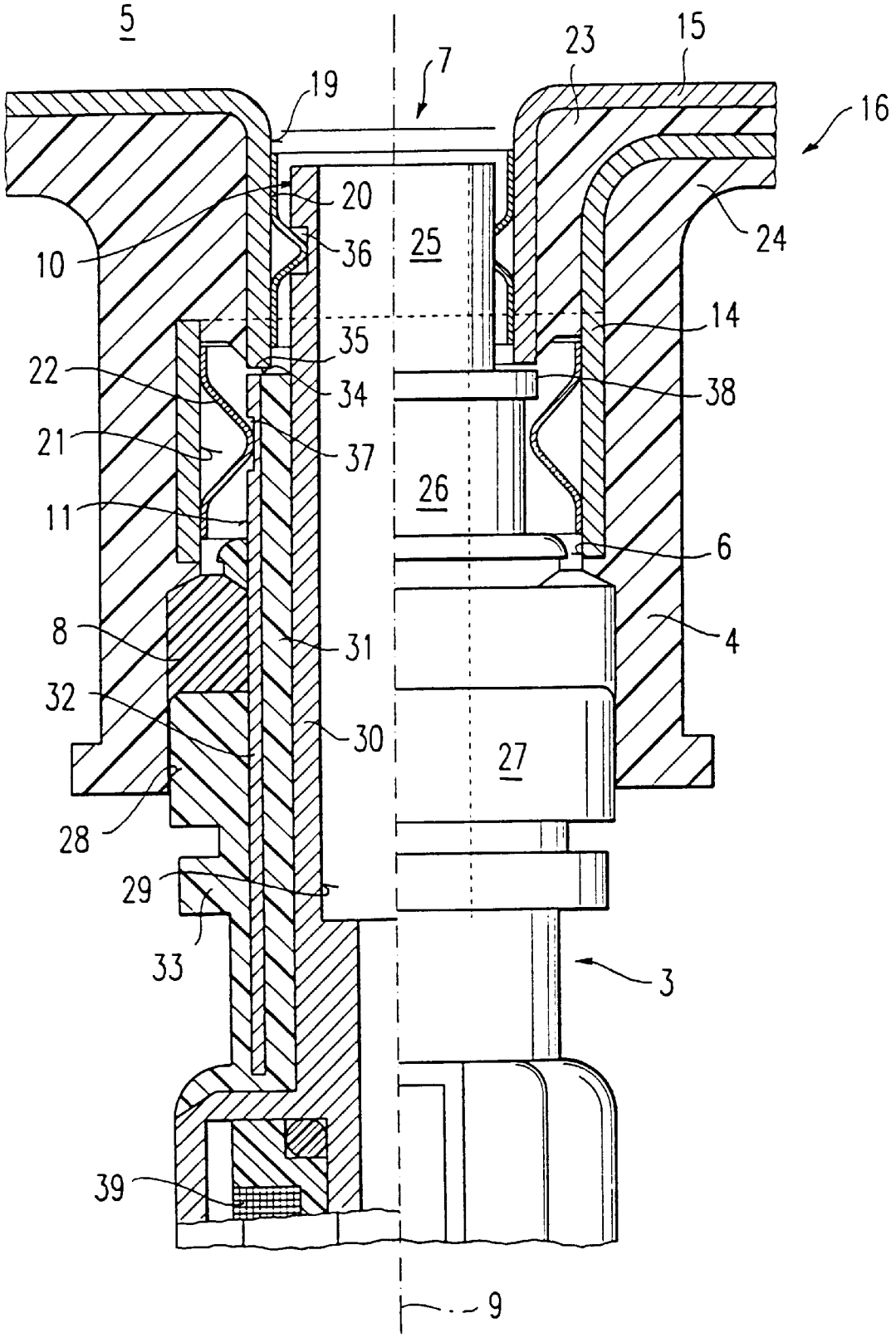
FIG. 3 shows a partial section through the fuel distributor according to the present invention and a fuel injection valve inserted into this fuel distributor according to the present invention.

FIG. 3 shows another embodiment of the arrangement, substantially corresponding to the one shown in FIG. 2. The elements which have already been described with reference to FIGS. 1 and 2 are labeled with the same reference numbers, so they need not be described.

The further development of the embodiment shown in FIG. 3 provides that in circumferential recesses 36 and 37, for example, are provided in contact faces 10 and 11. When connecting segment 7 is inserted into valve receptacle opening 6, clamping springs 20 and 22 engage with these recesses 36 and 37, locking fuel injection valve 3 on fuel distributor 1. The connection according to the present invention between valve receptacles 4 and fuel injection valves 3 therefore simultaneously fulfills the functions of establishing the fuel supply, electrically contacting the fuel injection valves and locking the fuel injection valves on fuel distributor 1. These three functions are combined into a single assembly step, namely inserting fuel valves 3 into valve receptacle openings 6. This greatly reduces the cost of assembly.

The present invention is not limited to the embodiments described and shown herein. In particular, more than two electric contacts can also be established through the connection according to the present invention of fuel injection valves 3 with fuel distributor 1. Therefore, additional clamping springs are provided in valve receptacle openings 6 and additional contact faces are provided on connecting segments 7 of fuel injection valves 3. Valve receptacle openings 6 and connecting segments 7 may optionally also have additional steps. For improved locking of fuel injection valves 3 on fuel distributor 1, projections, e.g., in the form of sawtooth projections may be provided on the housing of fuel injection valve 3 to engage in the respective openings of valve receptacles 4. Furthermore, an anti-rotation element may be provided to ensure a defined installed position of fuel injection valves 3, which is necessary with dual-jet valves in particular.

What is claimed is:

1. A fuel distributor for a fuel injection system of an internal combustion engine, the fuel distributor supplying fuel to a plurality of fuel injection valves each having a connecting segment, the fuel distributor comprising:

a fuel supply channel;

a plurality of valve receptacles, a number of the plurality of valve receptacles corresponding to a number of the plurality of fuel injection valves, the plurality of valve receptacles having receptacle openings directly communicating with the fuel supply channel, the connecting segment of each of the plurality of fuel injection valves being insertable into the receptacle openings;

electric conductors electrically connecting to the plurality of fuel injection valves and extending to the receptacle openings of the plurality of valve receptacles, the electrical conductors being directly integrated at least one of into the fuel distributor and onto the fuel distributor; and contact springs positioned in each of the receptacle openings, each of the contact springs connected to one of the electric conductors, wherein, after the connecting segment of one of the plurality of fuel injection valves is inserted into a respective one of the receptacle openings, the contact springs contact at least two contact faces on the connecting segment of the one of the plurality of fuel injection valves, wherein the receptacle opening of each of the plurality of fuel injection valves has first step portions, and the connecting segments of the plurality of fuel injection valves have second step portions, wherein the contact springs are arranged on the first step portions, and the contact faces are arranged on the second step portions, and wherein the contact springs are situated opposite to the contact faces, the contact springs contacting the connecting segments when the connecting segments are inserted into the receptacle openings.

2. The fuel distributor according to claim 1, wherein one of the contact faces is axially and radially offset from another one of the contact faces.

3. The fuel distributor according to claim 1, wherein one of the contact springs is axially and radially offset from another one of the contact springs.

4. The fuel distributor according to claim 1, wherein each of the electric conductors extends to a respective step of the first step portions, and the contact springs are pressed into the respective step to contact a respective conductor of the electric conductors extending to the respective step.

5. The fuel distributor according to claim 1, wherein the connecting segment of a respective valve of the plurality of fuel injection valves has a stepped hollow cylinder shape and has a central longitudinal opening for enabling a fuel to flow from the fuel supply channel to the respective valve, the connecting segment of the respective valve of the plurality of fuel injection valves having an external portion and stepped axially offset lateral cylindrical faces situated on the external portion, and wherein the contact faces are arranged on the stepped axially offset lateral cylindrical faces.

6. The fuel distributor according to claim 5, wherein each connecting segment of the plurality of the fuel injection valves includes:

a hollow cylindrical core composed of an electrically conducting material, a first insulation layer externally surrounding the hollow cylindrical core without covering an end section of the hollow cylindrical core, and a conduction layer composed of the electrically conducting material externally surrounding the first insulation layer, and wherein the hollow cylindrical core is a first face of the contact faces.

7. The fuel distributor according to claim 6, wherein the electrically conducting material includes a metal.

8. The fuel distributor according to claim 6, wherein each connecting segment of the plurality of the fuel injection valves further includes a second insulation layer externally surrounding the conduction layer without covering an end section of the conduction layer, and wherein the conduction layer is a second face of the contact faces.

9. The fuel distributor according to claim 8, wherein the first and second insulation layers are portions of a plastic sheathing of one of the plurality of fuel injection valves.

10. The fuel distributor according to claim 1, further comprising:

a stop face portion situated between the first step portions, wherein, when the connecting segment of one of the plurality of fuel injection valves is inserted into a respective one of the receptacle openings, an end face formed between the second step portions contacts the stop face.

11. A fuel distributor for a fuel injection system of an internal combustion engine, the fuel distributor supplying fuel to a plurality of fuel injection valves each having a connecting segment, the fuel distributor comprising:

a fuel supply channel;

a plurality of valve receptacles, a number of the plurality of valve receptacles corresponding to a number of the plurality of fuel injection valves, the plurality of valve receptacles having receptacle openings directly communicating with the fuel supply channel, the connecting segment of each of the plurality of fuel injection valves being insertable into the receptacle openings;

electric conductors electrically connecting to the plurality of fuel injection valves and extending to the receptacle openings of the plurality of valve receptacles, the electrical conductors being directly integrated at least one of into the fuel distributor and onto the fuel distributor; and contact springs positioned in each of the receptacle openings, each of the contact springs connected to one of the electric conductors, wherein, after the connecting segment of one of the plurality of fuel injection valves is inserted into a respective one of the receptacle openings, the contact springs contact at least two contact faces on the connecting segment of the one of the plurality of fuel injection valves, and wherein the electric conductors include a first conductor and further conductors, the first conductor extending along an inside surface of a wall of the fuel supply channel having a tubular shape, the further conductors being embedded in the wall of the fuel supply channel for insulating one of the further conductors from one another one of the further conductors and from the first conductor.

12. The fuel distributor according to claim 11, wherein the first conductor contacts each of the plurality of fuel injection valves, and each of the plurality of fuel injection valves is connected to one of the further conductors.

13. The fuel distributor according to claim 11, wherein the further conductors include ribbon cables and lie within the fuel distributor.

14. The fuel distributor according to claim 11, wherein the contact faces have recesses, the contact springs extending into the recesses to lock the plurality of fuel injection valves to the fuel distributor.

15. The fuel distributor according to claim 1, further comprising:

a plug connector integrally molded as a single piece with the fuel distributor, the plug connector including contact elements connected to at least one of the electric conductors.

* * * * *

UNITED STATES PATENT AND TRADEMARK OFFICE

CERTIFICATE OF CORRECTION

PATENT NO. : 6,062,200
DATED : May 16, 2000
INVENTOR(S) : Werner Hofmeister

It is certified that error appears in the above-identified patent and that said Letters Patent is hereby corrected as shown below:

Abstract,
Delete the first paragraph.
Line 1 of the second paragraph, change "With the novel fuel distributor, ..." to -- A fuel distributor includes --.

Column 1,
Line 52, change "... no. ..." to -- No. 0 530 337 --.

Column 2,
Line 6, insert -- , -- after "... vantage ...".

Column 3,
Line 35, delete " , " after "3 "--.
Line 36, insert -- a -- after "such".
Line 67, delete "serves to".

Column 5,
Line 67, delete "in".

Signed and Sealed this

Sixteenth Day of October, 2001

*Attest:*

Nicholas P. Godici

NICHOLAS P. GODICI
*Acting Director of the United States Patent and Trademark Office*

*Attesting Officer*